US009017108B2

(12) United States Patent
Suemitsu

(10) Patent No.: US 9,017,108 B2
(45) Date of Patent: Apr. 28, 2015

(54) ELECTRICAL CONNECTOR

(75) Inventor: Yoshifumi Suemitsu, Chiba (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 121 days.

(21) Appl. No.: 13/606,668

(22) Filed: Sep. 7, 2012

(65) Prior Publication Data

US 2013/0065446 A1 Mar. 14, 2013

(30) Foreign Application Priority Data

Sep. 8, 2011 (JP) ..... 2011-195683

(51) Int. Cl.
*H01R 13/502* (2006.01)
*H01R 13/422* (2006.01)

(52) U.S. Cl.
CPC ..... *H01R 13/4223* (2013.01)

(58) Field of Classification Search
USPC ..... 439/701, 686, 682, 752
See application file for complete search history.

(56) References Cited

U.S. PATENT DOCUMENTS 5,320,555 A * 6/1994 Okabe ..... 439/354
6,406,335 B2 * 6/2002 Sato et al. ..... 439/701
6,645,003 B2 * 11/2003 Yoshida et al. ..... 439/507
6,773,309 B1 * 8/2004 Shuey ..... 439/701
6,893,292 B2 * 5/2005 Yamamoto et al. ..... 439/595
7,297,032 B2 * 11/2007 Kobayashi et al. ..... 439/701
7,841,913 B2 * 11/2010 Hitchcock et al. ..... 439/752

FOREIGN PATENT DOCUMENTS

EP 2472678 A2 7/2012
JP 2007324050 A 12/2007
JP 2008130561 A 6/2008

OTHER PUBLICATIONS

European Search Report, dated Nov. 30, 2012, 7 pages.

* cited by examiner

*Primary Examiner* — Hien Vu
(74) *Attorney, Agent, or Firm* — Barley Snyder

(57) ABSTRACT

An electrical connector is provided. The electrical connector includes a comprising a first housing, a second housing removably fittable to the first housing, and a lock block disposed on the second housing and engageable with the first housing to secure the second housing at a predetermined position with the first housing. The lock block includes a first groove extending along a length of the lock block, a side portion in contact with the first groove, an end portion in contact with the first groove and orthogonal to the side portion, a side lock disposed on the side portion and securable with the first housing, and a first lock that is provided integrally with the end portion and secured to the first housing.

10 Claims, 6 Drawing Sheets

ELECTRICAL CONNECTOR

CROSS-REFERENCE TO RELATED APPLICATION

This application claims priority under 35 U.S.C. §119 to JP Patent Application No. 2011-195683 of Sep. 8, 2011.

FIELD OF THE INVENTION

The invention relates to an electrical connector and, in particular, to an electrical connector having lance housing and a housing main body to which the lance housing is fitted.

BACKGROUND

An electrical connector in which a lance serving as a primary locking means is integrally formed in a housing to prevent a contact (or a terminal metal fitting) from coming off from the housing has been well known. When the known electrical connector is downsized, it becomes difficult to form the lance integrally with the correspondingly downsized housing.

Therefore, an electrical connector has been known in which a housing provided with a lance is formed as a separate member, and this lance housing is fitted to a housing main body. When the lance is downsized, a problem arises in which the function for preventing a contact from coming off is lowered. In view of this problem, a retainer serving as a secondary locking means is fitted to the housing main body. The retainer may be formed as a member separate from the housing main body and the housing lance (for example, see Japanese Patent Application Laid-Open No. 2007-324050), or the retainer may be integrally formed with the housing main body or the lance housing with a hinge interposed therebetween (for example, see Japanese Patent Application Laid-Open No. 2008-130561).

When fitting a lance housing to a housing main body, a lock provided in the lance housing is secured to the housing main body so that the lance housing is secured so as not to come off from a predetermined position of the housing main body. This lock is typically formed integrally with an elastically deformable member provided on the lance housing. For example, a configuration has been proposed in which locks are formed in two directions orthogonal to each other, that is, for example, in a width direction and a frontward direction (or a rearward direction) of the lance housing, so that the lance housing is more reliably secured to the housing main body.

Meanwhile, the lance housing needs to be positioned onto the housing main body with high precision. If the lance housing has a positional deviation from the housing main body, a problem arises in inserting a contact. For this reason, for example, a positioning groove (or a protrusion) is provided on the lance housing while a protrusion (or a groove) to be inserted into the positioning groove is provided on the housing main body.

However, it is occasionally difficult to secure sufficient space that allows the locks in two directions and the positioning groove to be provided with a downsized lance housing.

SUMMARY

The invention has been made in view of these problems, and its object is to provide an electrical connector having a first housing, a second housing removably fittable to the first housing, and a lock block disposed on the second housing and engageable with the first housing to secure the second housing at a predetermined position with the first housing. The lock block includes a first groove extending along a length of the lock block, a side portion in contact with the first groove, an end portion in contact with the first groove and orthogonal to the side portion, a side lock disposed on the side portion and securable with the first housing, and a first lock that is provided integrally with the end portion and secured to the first housing.

BRIEF DESCRIPTION OF THE DRAWINGS

The features and advantages of the invention should become apparent from the following description when taken in conjunction with the accompanying drawings, in which.

DETAILED DESCRIPTION OF THE EMBODIMENT(S)

The embodiments of the invention will now be described in detail with reference to the accompanying drawings.

Figure 1A:
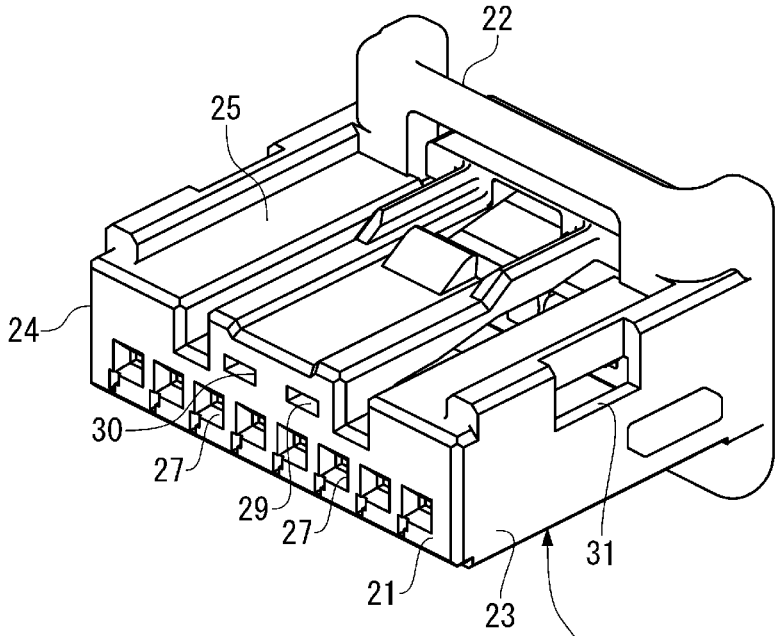
FIG. 1A is a perspective view of a plug housing of an electrical connector according to the invention.
Figure 1B:
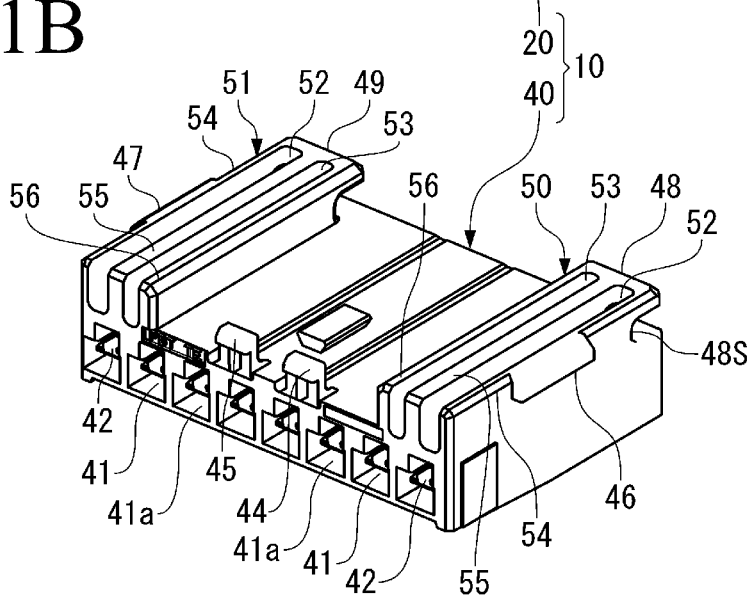
FIG. 1B is a perspective view of a lance housing of the electrical connector according to the invention.
Figure 2:
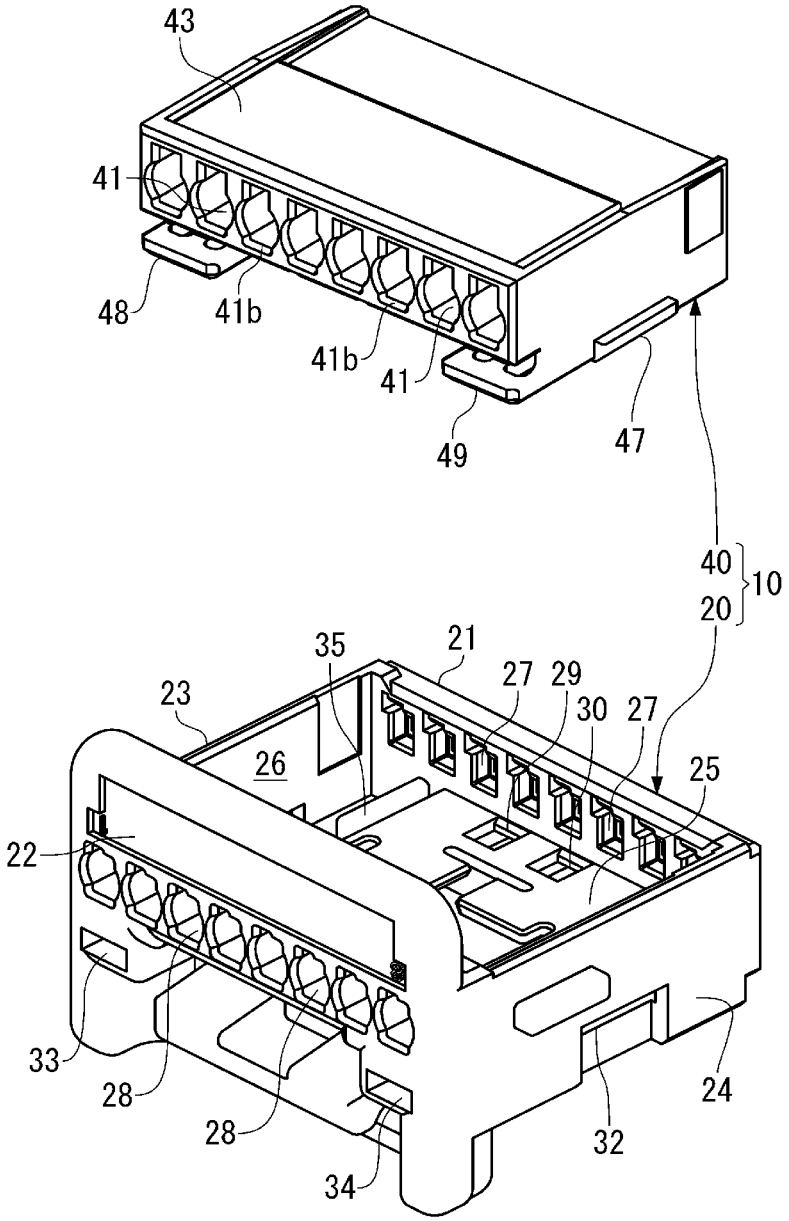
FIG. 2 is a perspective view of the plug and lance housing shown in FIG. 1A and 1B.
Figure 3A:
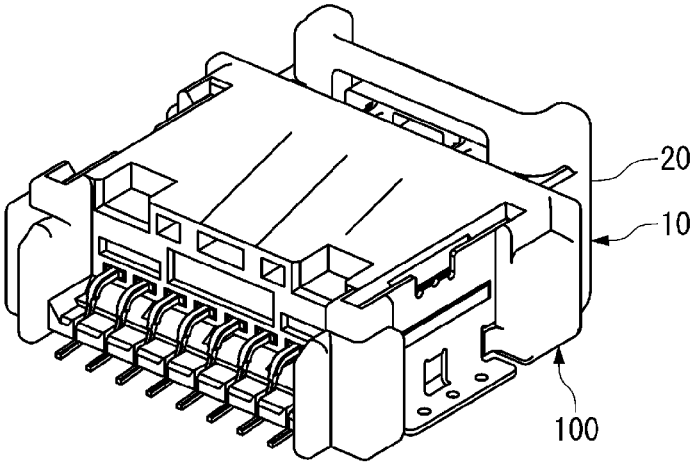
FIG. 3A is a perspective view of an electrical connector assembly in which the electrical connector according to the invention is mated with a mating connector.
Figure 3B:
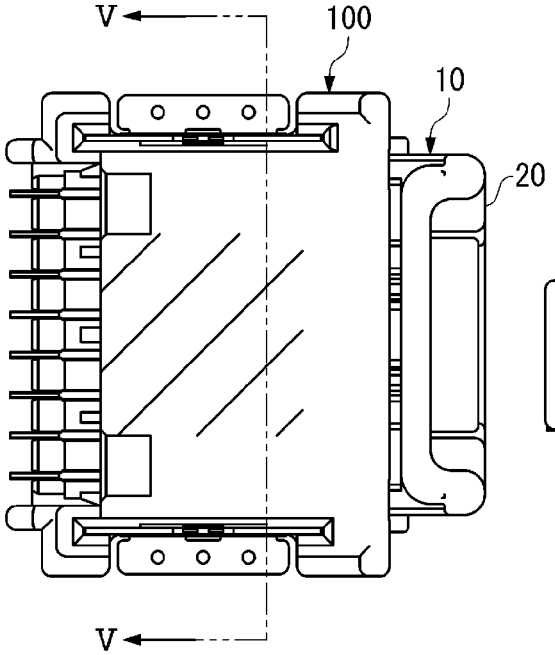
FIG. 3B is a plan view of the electrical connector assembly shown in FIG. 3A.
Figure 3C:
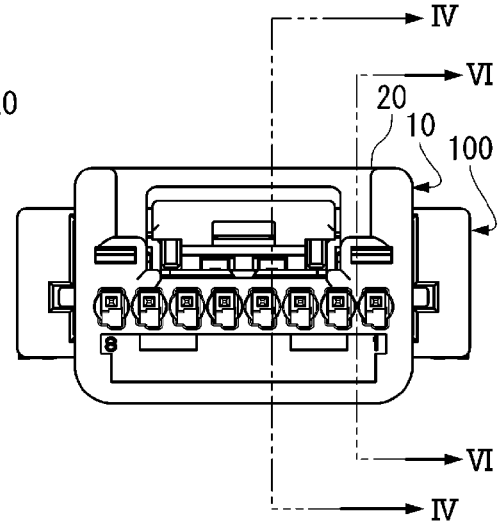
FIG. 3C is a front view of the electrical connector assembly shown in FIG. 3A.

As shown in FIG. 1A, FIG. 1B and FIG. 2, an electrical connector 10 (hereinafter, referred to simply as a connector) in accordance with the shown embodiment includes a plug-type first housing 20 (i.e. female housing in the shown embodiment) and a second housing 40 (i.e. lance housing), and is provided with a contact (not shown; i.e. contact). As shown in FIGS. 3A to 3C, when the connector 10 is mated with a mating connector 100, a mating contact (i.e. mating contact) provided in the mating connector 100 and the contact are electrically connected to each other. The connector 10 is formed such that the first housing 20 and the second housing 40 are injection-molded by using an insulating resin, and the contact is formed by punching out, for example, a copper alloy plate having excellent conductivity and performing bending process thereon.

The first housing 20 is provided with a front wall 21, and a rear wall 22 that faces the front wall 21 with a space being placed in a front to rear direction. Between the front wall 21 and the rear wall 22, a housing chamber 26 to which the second housing 40 is fitted is provided. The housing chamber 26 is marked off by side walls 23 and 24 that are provided to face with each other in the width direction, the front wall 21, the rear wall 22, and an upper wall 25 that connects the side walls 23 and 24, and forms a space surrounded by the front wall 21, the rear wall 22, the side walls 23 and 24, and the upper wall 25.

In the connector 10, a side that is mated with the mating connector 100, that is, a front side of FIGS. 1A and 1B is defined as "front", and a side from which a wire connected to the contact is drawn out, that is, a rear side of FIG. 1 is defined as "rear". In the first housing 20, a side on which the housing chamber 26 opens is defined as "lower side", and a side opposite to the lower side is defined as "upper side".

In the first housing 20, a plurality of terminal receiving passageways 27 to which mating contacts of the mating connector 100 are inserted are formed on the front wall 21. In the first housing 20, a plurality of terminal insertion passageways 28 through which contacts are inserted and through which wires connected to the inserted contacts are drawn out are formed on the rear wall 22.

The first housing 20 is provided with front lock receiving passageways 29 and 30 that are engaged with front locks 44 and 45 of the second housing 40 to be described later and formed on the front side of a surface of the upper wall 25 that faces the housing chamber 26. The first housing 20 is further provided with side lock receiving passageways 31 and 32 that are engaged with side locks 46 and 47 of the second housing to be described later, and formed on each of the side walls 23 and 24. Furthermore, the first housing 20 is provided with rear lock receiving passageways 33 and 34 that are engaged with rear locks 48 and 49 of the second housing to be described later, and formed respectively on the opposite end portions in the width direction of the rear wall 22.

Still further, the first housing 20 is provided with positioning guides 35 and 36 formed on a surface of the upper wall 25 facing the housing chamber 26. The positioning guides 35 and 36 are formed along the respective side walls 23 and 24 with a distance in the width direction, and in FIG. 2, the positioning guide 36 is located behind the side wall 24, and is not viewed. The positioning guides 35 and 36 are inserted into inner grooves 53, 53 formed in the second housing 40 so that the first housing 20 and the second housing 40 are positioned in the width direction with respect to each other.

The second housing 40 is fitted into the housing chamber 26 of the first housing 20 so as to prevent the contact from coming off.

The second housing 40 is provided with a terminal accommodating chamber 41 that penetrates through the second housing 40 from the front side to the rear side to accommodate the contact. The terminal accommodating chamber 41 is provided with a plurality of receiving openings 41*a* corresponding to the terminal receiving passageways 27 of the first housing 20, which are provided on the front end side, and a plurality of terminal insertion openings 41*b* corresponding to the terminal insertion passageways 28 of the first housing 20, which are formed on the rear end side.

Figure 4A:
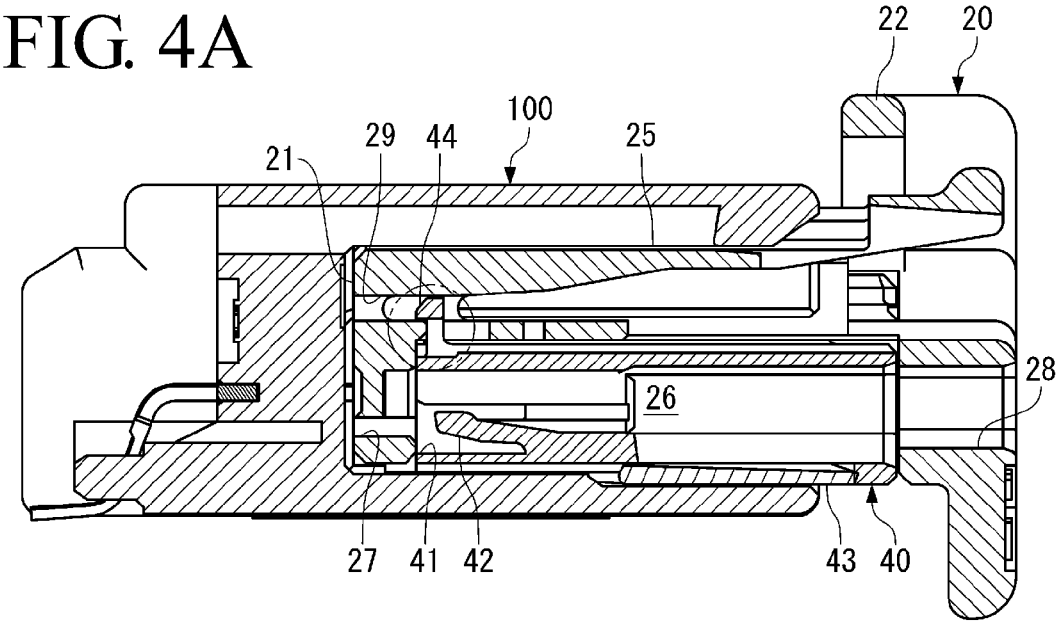
FIG. 4A is a cross-sectional view taken along a IV-IV line of FIG. 3C.

In the second housing 40, a housing lance 42 that protrudes into the terminal accommodating chamber 41 is integrally formed with the second housing 40 (see FIG. 4A). By locking each of the contacts inserted into the terminal accommodating chamber 41, the housing lance 42 prevents the contacts from being drawn rearward into the connector 10.

The housing lance 42 functions as a means for primarily locking the contact, and the second housing 40 is provided with a hinge 43 serving as a means for secondarily locking the contacts. The hinge 43 is provided so as to rotate relative to the second housing 40 centered on its rotation shaft provided on the front side. The hinge 43 is provided with a lock portion (omitted from the drawing) that locks each contact, and when placed at a position shown in the FIG. 3A, the lock portion locks the contact so that the contact is prevented from being drawn rearward of the connector 10. The hinge 43 has basically the same structure and operations as those disclosed in Japanese Patent Application Laid-Open No. 2008-130561, and the explanation thereof will be omitted in the following description.

On the second housing 40, the front locks 44 and 45 are formed on the front end side of the upper surface. As described earlier, the front locks 44 and 45 are respectively secured to the first housing 20 through the front lock receiving passageways 29 and 30.

On the second housing 40, side locks 46 and 47, which are respectively secured to the first housing 20 through the side lock receiving passageways 31 and 32, are further formed. The side locks 46 and 47 are respectively provided on the opposite ends of the second housing 40 in the width direction.

Furthermore, on the second housing 40, rear locks 48 and 49, which are respectively secured to the first housing 20 through the rear lock receiving passageway 33 and 34, are formed. The rear locks 48 and 49 are respectively provided on the opposite ends of the second housing 40 in the width direction.

The side locks 46 and 47 and the rear locks 48 and 49 are integrally formed on lock blocks 50 and 51. The lock blocks 50 and 51, each of which is formed into a rectangular parallelepiped shape, are provided on the opposite ends in the width direction of the upper surface of the second housing 40. The lock blocks 50 and 51 have the same structure except for their layouts, and, therefore, the following description only deals with the lock block 50.

On the lock block 50, an outer groove 52 that extends in a front to rear direction and an inner grove 53 that is in parallel with the outer groove 52 and located on the inner side in the width direction of the outer groove 52 are provided. In the lock block 50, an outer wall 54 is provided on the outside of the outer groove 52, a partition wall 55 is provided between the outer groove 52 and the inner groove 53, and an inner wall 56 is provided on the inner side from the inner groove 53. The outer wall 54 and the partition wall 55 are adjacent to the outer groove 52, and the partition wall 55 and the inner wall 56 are adjacent to the inner groove 53.

Due to the outer groove 52, the outer wall 54 functions as a spring member with its lower end serving as a fixed end, relative to the second housing 40, and when a force is applied in the width direction, the wall 54 deflects in a direction of the applied force. The side lock 46 (47) to be locked in the side lock receiving passageway 31 (32) of the first housing 20 is provided on the outer wall 54 to be elastically deformed in accordance with the deflection of the outer wall 54.

When the second housing 40 is fitted into the first housing 20, the positioning guide 35 (36) of the first housing 20 is inserted into the inner groove 53. Thus, the first housing 20 and the second housing 40 are positioned with respect to each other in the width direction.

The aforementioned rear lock 48 (49) is provided on the rear end side of the lock block 50 (51). The rear lock 48 is a cantilevered member with a portion connected to the outer wall 54, the partition wall 55 and the inner wall 56 serving as a fixed end 48S, and protrudes rearward from the rear end portion of the outer wall 54, the partition wall 55 and the inner wall 56. The outer groove 52 and the inner groove 53 extend in the rear lock 48 beyond the fixed end 48S. The portions of the outer groove 52 and the inner groove 53 extended beyond the fixed end 48S penetrate through the rear lock 48 in the vertical direction (see FIG. 6B), and therefore rigidity of the rear lock 48 is lowered. Thus, when a force is applied to the rear lock 48 in the vertical direction, the rear lock 48 deflects easily in a direction of the applied force.

When the second housing 40 is fitted into the first housing 20, the first housing 20 is secured to the second housing 40 in the following manner.

Figure 4B:
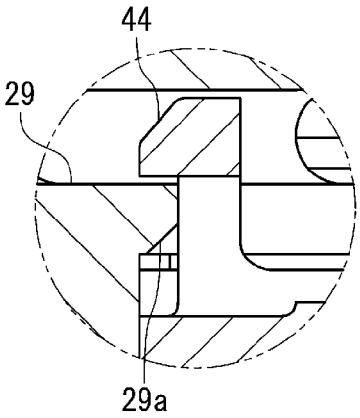
FIG. 4B is a partially expanded view of FIG. 4A.

As shown in FIGS. 4A and 4B, when the front lock 44 provided in the second housing 40 goes over the front catch 29*a* (FIG. 4B) facing the front lock receiving passageway 29, the front lock 44 is brought into an engaged relation with the front catch 29*a*. In the same manner, when the other front lock 45 provided in the second housing 40 goes over a lock (not shown) facing the front lock receiving passageway 30, the front lock 45 is brought into an engaged relation with the lock. As such, the second housing 40 is secured to the first housing 20 on the front side.

Figure 5A:
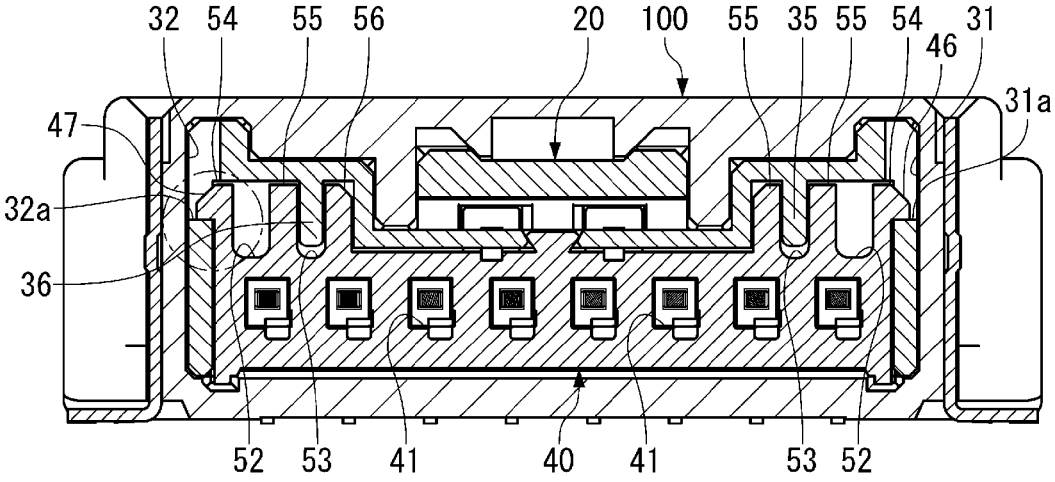
FIG. 5A is a cross-sectional view taken along a V-V line of FIG. 3B.
Figure 5B:
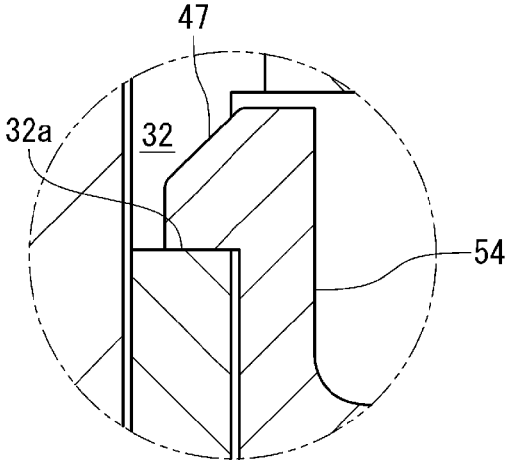
FIG. 5B is a partially expanded view of FIG. 5A.

Next, as shown in FIGS. 5A and 5B, when the side locks 46 and 47 provided on the second housing 40 respectively go over the side catches 31*a* and 32*a* (FIG. 5B) facing the side lock receiving passageways 31 and 32 of the first housing 20, each of the side locks 46, 47 is brought into engagement with the lock 31*a* (32*a*), as shown in FIG. 5B. As such, the second housing 40 is secured to the first housing 20 in the width direction. When the side locks 46 and 47 respectively go over the side catches 31*a* and 32*a*, the outer wall 54 deflects inward.

As shown in FIG. 5A, the positioning guide 35 of the first housing 20 is inserted into the inner groove 53 of the second housing 40, and thereby positioning the second housing 40 and the first housing 20 with respect to each other, as described earlier. Since the positioning guide 35 is inserted into the inner groove 53 and the outer groove 52 is left open, no influence is given to the deflection of the outer wall 54.

Figure 6A:
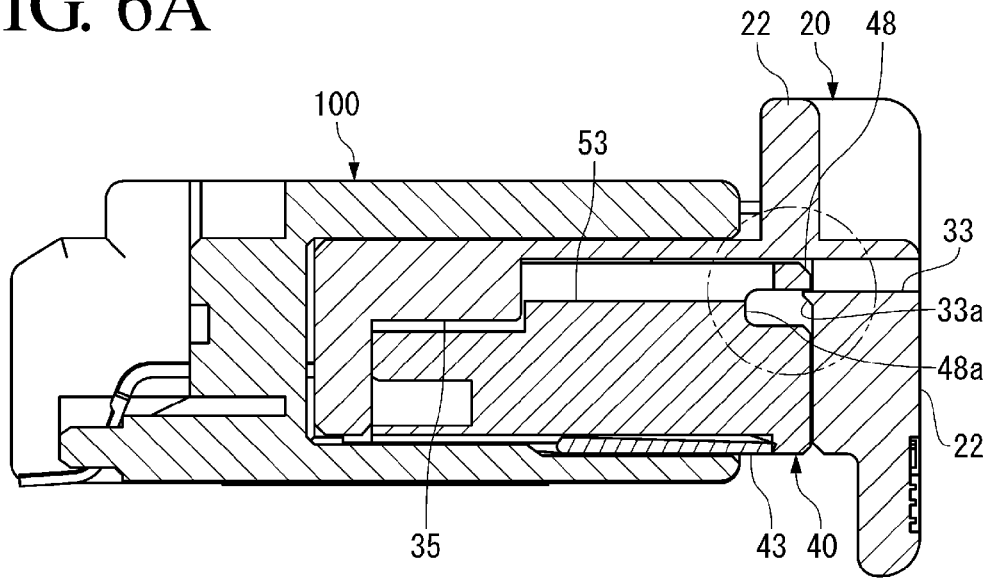
FIG. 6A is a cross-sectional view taken along a VI-VI line of FIG. 3C.
Figure 6B:
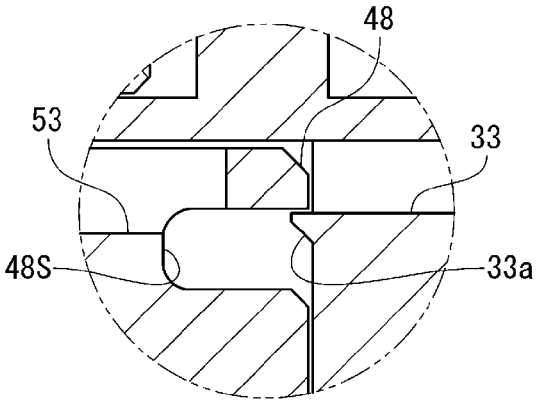
FIG. 6B is a partially expanded view of FIG. 6A.

As shown in FIGS. 6A and 6B, when the rear lock 48 provided in the second housing 40 goes over the rear catch 33*a* (FIG. 6B) facing the rear lock receiving passageway 33 of the first housing 20, the rear lock 48 is brought into an engaged relation with the rear catch 33*a*. In the same manner, when the other rear lock 49 provided in the second housing 40 goes over the lock (not shown) facing the rear lock receiving passageway 34 of the first housing 20, the rear lock 49 is brought into an engaged relation with the lock. As such, the second housing 40 is secured to the first housing 20 on the rear end.

The connector 10 as described above has a structure in which the side lock 46 and the rear lock 48 are provided integrally with the lock block 50. In the connector 10, the outer groove 52 and the inner groove 53 are provided on the lock block 50 so that the side lock 46 and the rear lock 48 can elastically deform easily. That is, since the connector 10 concentrates locks that can elastically deform easily in two directions on the lock block 50, the second housing 40 can be appropriately fixed to the first housing 20, and the small size of the second housing 40 can be maintained.

Moreover, the positioning guide 35 of the first housing 20 is inserted into the inner groove 53 to position the second housing 40 and the first housing 20 with respect to each other, and therefore, it is not necessary to form another groove to which the positioning guide 36 is inserted.

In the connector 10 as described above, an explanation has been given by exemplifying a structure in which the side lock 46 and the rear lock 48 are provided integrally with the lock block 50. However, there are some choices among locks to be provided integrally with the lock block 50. For example, depending on positions at which the front lock 44 is provided, the front lock 44 may be provided integrally with the lock block 50, or the front lock 44 and the side lock 46 may be provided integrally with the lock block 50.

Further, in the above-described connector 10, the two grooves, that is, the outer groove 52 and the inner groove 53 are provided. However, even in the case where only one groove, for example, the outer groove 52 is provided on the lock block 50, effects of the invention, such as ensuring elastic deformation of the side lock 46 and ensuring elastic deformation of the rear lock 48, can be obtained. In such embodiment, in the case where the positioning guide 35 is inserted into the outer groove 52, the insertion is preferably carried out at a position far from the side lock 46. This is because the deflection of the outer wall 54 needs to be ensured so as to allow the side lock 46 to deform elastically.

In accordance with the invention, even in ca case where locks are provided in two directions of, for example, a side surface in a width direction of a lance housing and a front (or rear) side surface, a small size of an electrical connector can be maintained.

In addition to these, it is needless to say that the invention is not limited to the above embodiments, but that various changes may be made within the scope not departing from the gist of the invention.

What is claimed is:

1. An electrical connector comprising:

a first housing having a front wall, a rear wall, a pair of side walls, an upper wall, a housing chamber positioned therebetween, and a positioning guide disposed on the upper wall facing the housing chamber;

a second housing removably fittable to the first housing; and a lock block disposed on and extending upward from a planar surface of the second housing and engageable with the first housing to secure the second housing at a predetermined position with the first housing, the lock block having:

a first groove extending along a length of the lock block and receiving the positioning guide;

a side portion connected with the first groove;

a rear end portion connected with the first groove and orthogonal to the side portion;

a side lock disposed on the side portion and securable with the first housing; and a first lock extending from the rear end portion and securable to the first housing.

2. The electrical connector according to claim 1, wherein the lock block further includes a second groove formed adjacent to and extending parallel to the first groove and in contact with the end portion.

3. The electrical connector according to claim 1, wherein the positioning guide is formed along one of the pair of side walls.

4. The electrical connector according to claim 1, wherein the side portion is an outer wall of the lock block.

5. The electrical connector according to claim 1, wherein the first lock is integrally formed with the end portion.

6. The electrical connector according to claim 1, further comprising a second lock disposed on a front end side of an upper surface of the second housing.

7. The electrical connector according to claim 6, wherein the first housing includes a front lock receiving passageway to engage the second lock.

8. The electrical connector according to claim 7, wherein the first housing further includes a side lock receiving passageway to engage the side lock.

9. The electrical connector according to claim 8, wherein the first housing includes a second lock receiving passageway being engageable with the first lock.

10. An electrical connector comprising:

a first housing having:

a front wall;

a rear wall;

a pair of side walls;

an upper wall;

a housing chamber positioned between the front wall, the rear wall, the pair of side walls, and the upper wall; and a positioning guide disposed on the upper wall facing the housing chamber and formed along one of the pair of side walls;

a second housing removably fittable to the first housing; and a lock block disposed on the second housing and engageable with the first housing to secure the second housing at a predetermined position with the first housing, the lock block having:

a first groove extending along a length of the lock block;

a side portion connected with the first groove;

a rear end portion connected with the first groove and orthogonal to the side portion;

a side lock disposed on the side portion and securable with the first housing;

a first lock extending from the rear end portion and securable to the first housing;

and a second groove formed adjacent to and extending parallel to the first groove and connected with the rear end portion;

wherein the positioning guide is insertable into the first groove.

* * * * *